US010983471B2

(12) United States Patent
Noguchi

(10) Patent No.: US 10,983,471 B2
(45) Date of Patent: Apr. 20, 2021

(54) IMAGE FORMING APPARATUS AND CONVEYING UNIT

(71) Applicant: CANON KABUSHIKI KAISHA, Tokyo (JP)

(72) Inventor: Tomio Noguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 372 days.

(21) Appl. No.: 16/164,232

(22) Filed: Oct. 18, 2018

(65) Prior Publication Data

US 2019/0129343 A1 May 2, 2019

(30) Foreign Application Priority Data

Oct. 30, 2017 (JP) ..... JP2017-209485

(51) Int. Cl.

| | |
|---|---|
| ***G03G 15/00*** | (2006.01) |
| ***B65H 3/44*** | (2006.01) |
| ***B65H 29/12*** | (2006.01) |
| ***B65H 5/06*** | (2006.01) |

(52) U.S. Cl.

CPC ..... *G03G 15/6511* (2013.01); *B65H 3/44* (2013.01); *B65H 5/062* (2013.01); *B65H 29/125* (2013.01); *B65H 2301/531* (2013.01); *B65H 2404/143* (2013.01); *G03G 15/6558* (2013.01)

(58) Field of Classification Search

CPC .. G03G 15/6511; G03G 15/6558; B65H 3/44; B65H 5/062; B65H 29/125; B65H 2301/531; B65H 2404/143

See application file for complete search history.

(56) References Cited

U.S. PATENT DOCUMENTS

| | | | | |
|---|---|---|---|---|
| 4,999,678 | A * | 3/1991 | Tange | G03G 21/0005 15/256.53 |
| 9,016,690 | B2 * | 4/2015 | Fukunaga | G03G 21/168 271/273 |
| 9,026,021 | B2 * | 5/2015 | Shimizu | G03G 15/6558 399/326 |
| 2005/0201774 | A1 * | 9/2005 | Yamagata | G03G 15/6511 399/98 |
| 2005/0218584 | A1 * | 10/2005 | Dan | B65H 3/0669 271/127 |
| 2007/0231033 | A1 * | 10/2007 | Okazaki | B65H 5/062 399/388 |
| 2008/0048384 | A1 * | 2/2008 | Kusama | G03G 15/6511 271/145 |
| 2011/0150553 | A1 * | 6/2011 | Akatsuka | B65H 5/062 400/611 |

(Continued)

FOREIGN PATENT DOCUMENTS

| | | |
|---|---|---|
| JP | 2003-276893 A | 10/2003 |
| JP | 2005-300615 A | 10/2005 |
| JP | 2006-117358 A | 5/2006 |

*Primary Examiner* — David H Banh

(74) *Attorney, Agent, or Firm* — Canon U.S.A., Inc. I.P. Division

(57) ABSTRACT

An image forming apparatus includes a scraper, in contact with an end roller which is at least one of a plurality of rollers, to collect a substance adhering to the end roller, a cleaning unit that holds the end roller and the scraper, and an linking unit that moves the cleaning unit in the axial direction of the end roller in conjunction with the movement of a sheet-width regulating plate.

15 Claims, 16 Drawing Sheets

(56) References Cited

U.S. PATENT DOCUMENTS

| | | | | |
|---|---|---|---|---|
| 2013/0223859 | A1* | 8/2013 | Wakamatsu | G03G 21/105 399/34 |
| 2014/0186071 | A1* | 7/2014 | Sato | G03G 15/0194 399/110 |
| 2018/0275554 | A1* | 9/2018 | Yamazaki | G03G 15/0225 |

* cited by examiner

IMAGE FORMING APPARATUS AND CONVEYING UNIT

BACKGROUND OF THE INVENTION

Field of the Invention

The present disclosure relates to image forming apparatuses, such as copying machines, printers, and facsimile machines, having a function for forming images on a recording medium, such as a sheet.

Description of the Related Art

In image forming apparatuses using an electrophotographic method or the like, if paper dust (fibers and fillers) generated from paper (a recording material) adheres to an image bearing member, such as a photosensitive member or an intermediate transfer member, image defects, such as streaks on the image or blank areas (lack areas) in the image) sometimes occur. If paper dust is nipped in a cleaning member for removing toner from the image bearing member, a cleaning problem can occur. For those reasons, in some image forming apparatuses using the electrophotographic method, paper dust is removed from sheets conveyed from an image bearing member to a transfer portion at which toner images are transferred to the sheets.

Japanese Patent Laid-open No. 2003-276893 discloses a configuration for collecting paper dust upstream from a transfer portion in a sheet conveying direction with a conveying roller and collecting the paper dust adhering to the conveying roller using a collecting member.

However, in the configuration disclosed in Japanese Patent Laid-open No. 2003-276893, when a plurality of separated rollers are employed as conveying rollers, an appropriate arrangement relationship between the lateral positions of the separated rollers and the positions of the ends of the paper may not be maintained. For example, a plurality of separated rollers are arranged according to small-size standard paper. When large-size standard paper is conveyed with the separated rollers, no conveying rollers are present at positions corresponding to the ends of the paper, making it difficult to collect paper dust at the ends of the paper. Furthermore, providing a plurality of separated rollers according to the size of paper that can be passed through the image forming apparatus increases the number of separated rollers, increasing the cost.

SUMMARY OF THE INVENTION

The present disclosure provides an image forming apparatus including an image bearing member, a transfer member, a stack member on which sheets are to be stacked, a plurality of driving rotary members, a regulation unit, a plurality of driven rotary members, a first collecting member, a first holding unit, and an linking unit. The image bearing member is configured to carry a toner image. The transfer member forms a transfer portion with the image bearing member and is configured to transfer the toner image at the transfer portion. The plurality of driving rotary members are configured to convey the sheets stacked on the stack member toward the transfer portion by rotating when driving is transmitted. The driving rotary members includes a first driving rotary member. The regulation unit is configured to regulate an end of the sheets stacked on the stack member. The plurality of driven rotary members are respectively opposed to the plurality of driving rotary members.

The driven rotary members are driven by rotation of the opposing driving rotary members. The driven rotary members include a first driven rotary member. The first collecting member is in contact with at least the first driven rotary member to collect a substance adhering to the first driven rotary member. The first holding unit is configured to hold the first driven rotary member and the first collecting member. The first holding unit includes a first working portion. The linking unit is configured to move the first holding unit in an axial direction of the first driven rotary member in conjunction with movement of the regulation unit.

Further features of the present disclosure will become apparent from the following description of exemplary embodiments with reference to the attached drawings.

DESCRIPTION OF THE EMBODIMENTS

First Embodiment

Embodiments of the present disclosure will be described hereinbelow with reference to the drawings. It is to be understood that the dimensions, materials, shapes, and relative positions of the components described in the following embodiments can be changed as appropriate according to the configurations of apparatuses that incorporate the present disclosure and various conditions and that the present disclosure is not limited to the embodiments.

Figure 1:
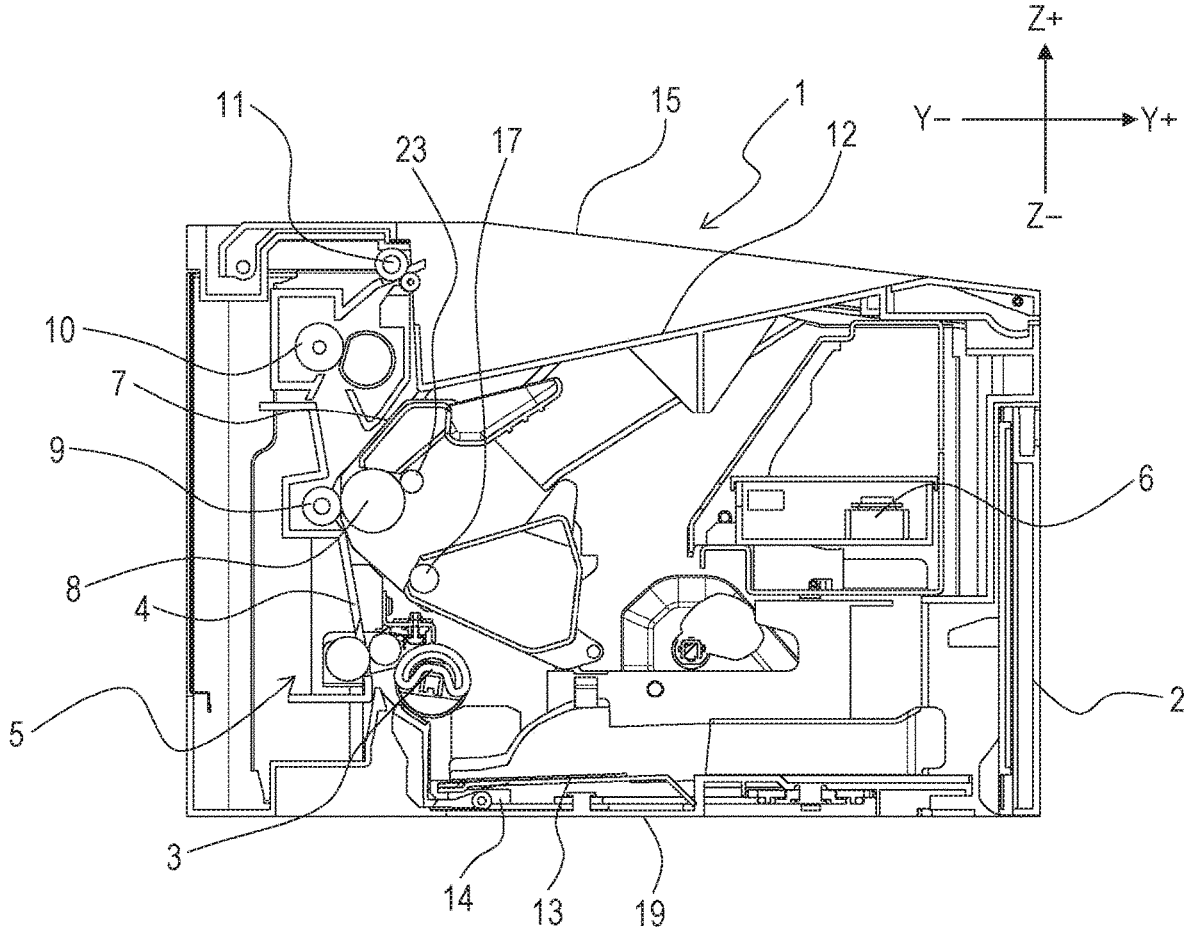
FIG. 1 is a cross-sectional view of an image forming apparatus according a first embodiment of the present disclosure illustrating the configuration thereof.
Figure 3:
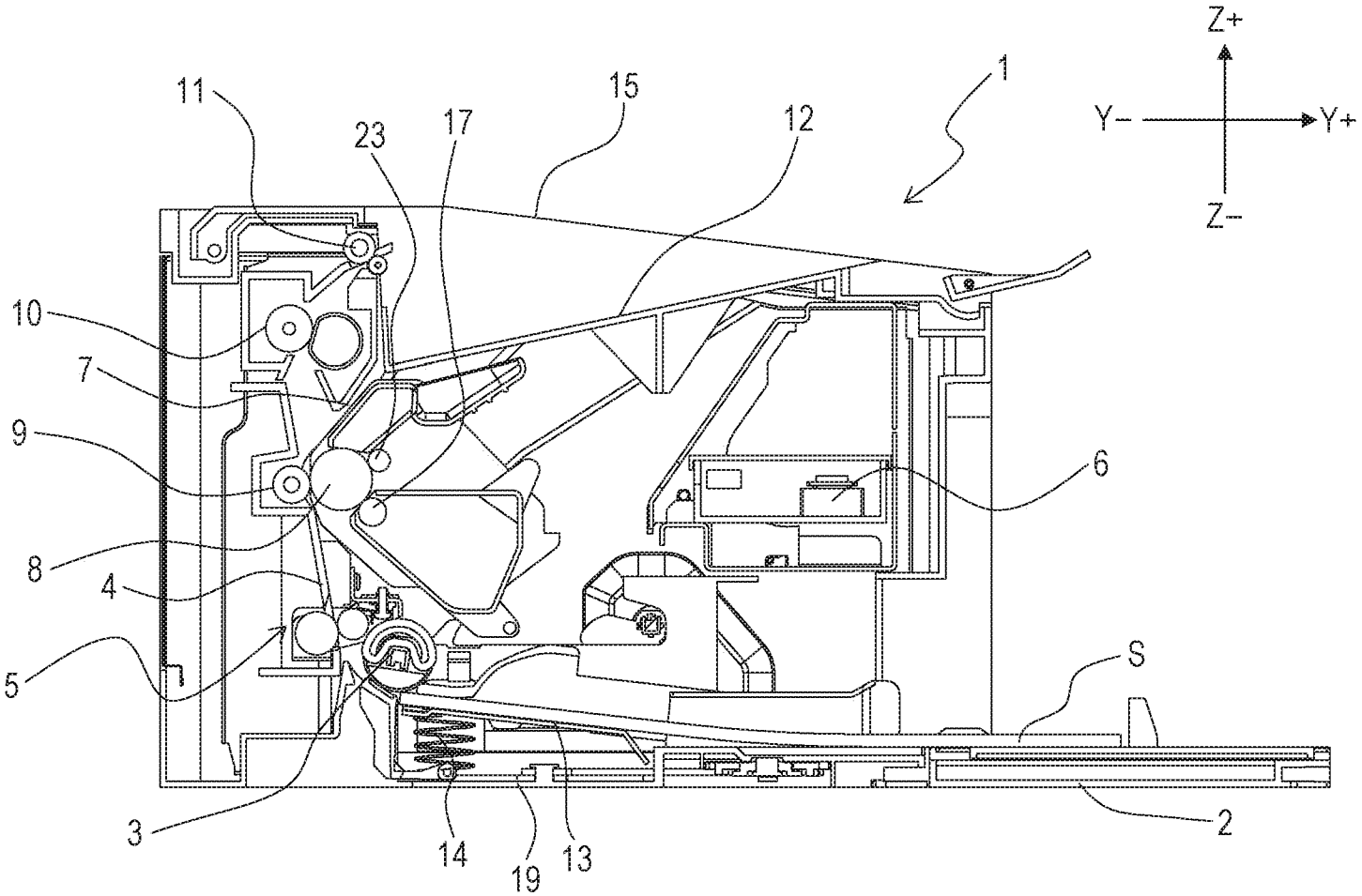
FIG. 3 is a cross-sectional view of the image forming apparatus according the first embodiment of the present disclosure illustrating the configuration thereof.

FIGS. 1 and 3 illustrate cross-sections of an image forming apparatus 1 using a general electrophotographic process. FIG. 1 is a cross-sectional view of the image forming apparatus 1 of the present embodiment not in use, with a sheet feed tray 2 housed therein. FIG. 3 is a cross-sectional view of the image forming apparatus 1 of the present embodiment in a printable state.

In FIG. 3, the sheet feed tray 2 of an openable and closable unit is open with respect to the apparatus main body and contains stacked sheets S. A lift plate 13 (a stack member) is disposed downstream in the direction in which the sheets S are conveyed. The sheets S are stacked on the lift plate 13. The lift plate 13 is urged toward a feeding roller 3 by a lift-plate spring 14 (an urging member).

When a print job signal is issued from a host computer (not illustrated) connected to the main body of the image forming apparatus 1, the feeding roller 3 disposed in the image forming apparatus main body rotates. The rotation of the feeding roller 3 causes the uppermost sheet of the sheets S stacked in the sheet feed tray 2 to be fed. The sheet S guided by a conveyance guide 4 is conveyed to a transfer portion by a conveying unit 5 at the same timing as the timing of a toner image formed on a photosensitive drum 8 (an image bearing member) in a process cartridge 7. The transfer portion is a nip area formed by the photosensitive drum 8 and a transfer roller 9 (a transfer member). The toner image is formed such that an electrostatic latent image is formed by exposing the photosensitive drum 8 charged by a charging roller 23 to light using a scanner unit 6, and the electrostatic latent image is developed with toner supplied by a developing roller 17. A transfer voltage is applied to the transfer roller 9 from a transfer power source, so that the toner image on the photosensitive drum 8 is transferred to the sheet S at the transfer portion. The sheet S to which the toner image is transferred is conveyed to a fixing unit 10, where the sheet S is subjected to a fixing process using heat and pressure, so that the toner image is fixed to the sheet S.

Figure 2:
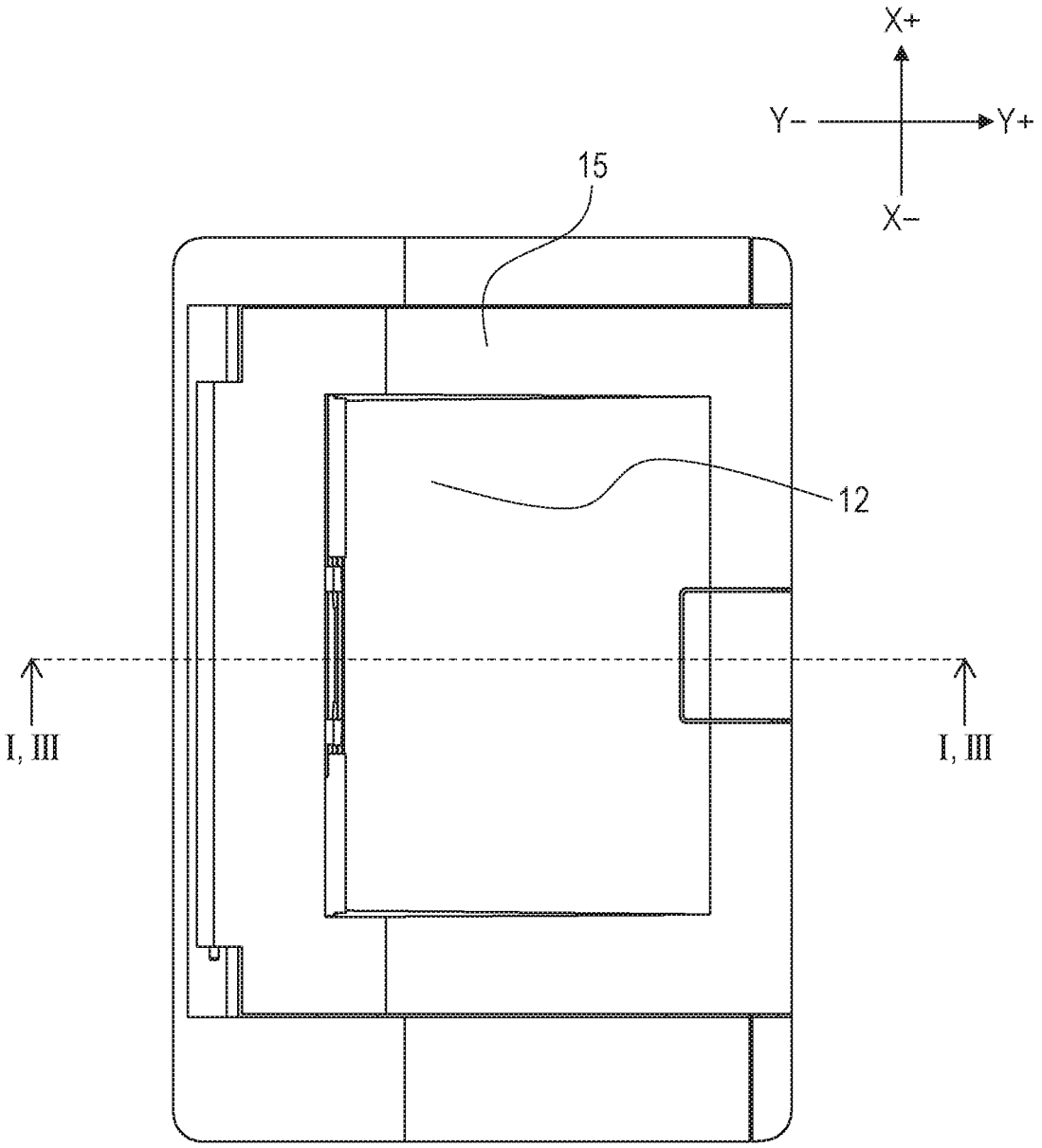
FIG. 2 is a top of the image forming apparatus according the first embodiment of the present disclosure illustrating the configuration thereof.

After the fixing process, the sheet S is discharged onto an output tray 12 by a discharge roller pair 11. An opening cover 15 including the output tray 12 is openably disposed on the image forming apparatus main body. FIG. 2 is a top view of the image forming apparatus main body. FIG. 1 is a cross-sectional view taken along dotted line I-I in FIG. 2. FIG. 3 is a cross-sectional view taken along dotted line III-III in FIG. 2.

Figure 4:
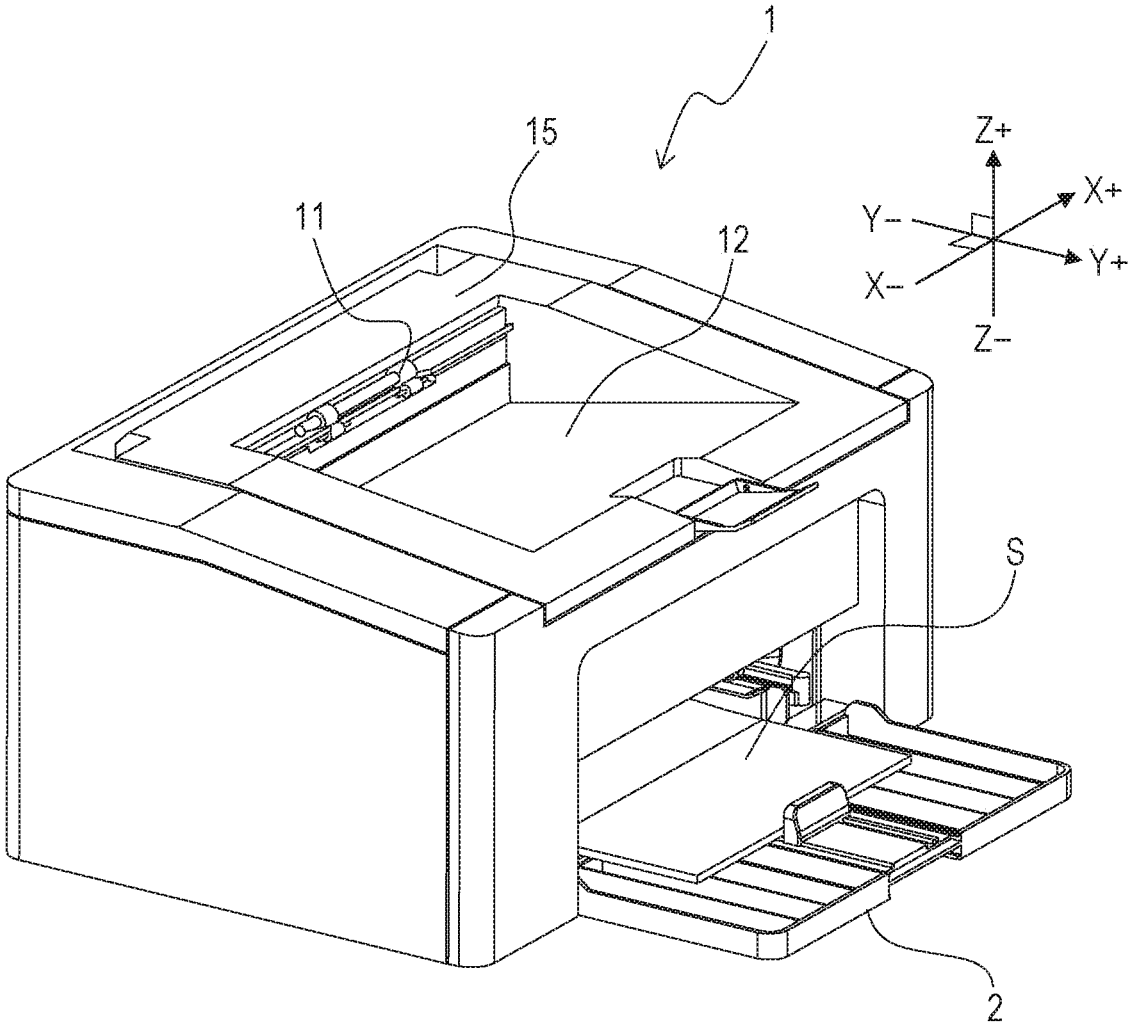
FIG. 4 is a perspective view of the image forming apparatus according the first embodiment of the present disclosure illustrating the configuration thereof.

FIG. 4 is a perspective view of the image forming apparatus 1 of the present embodiment illustrating a printable state. FIGS. 1 to 4 illustrate coordinate axes that are orthogonal to one another, in which the vertical direction of the main body is defined as Z-axis, of which the upward direction is defined as Z+ and the downward direction is defined as Z−. The direction of the rotation axes of the photosensitive drum 8 and the charging roller 23 is defined as X-axis, of which the direction to the right of the apparatus main body is defined as X+ and the direction to the left of the apparatus main body is defined as X−. The direction orthogonal to the Z-axis and the X-axis is defined as Y-axis, of which the direction to the front of the apparatus main body is defined as Y+ and the direction to the back of the apparatus main body is defined as Y−.

Figure 5:
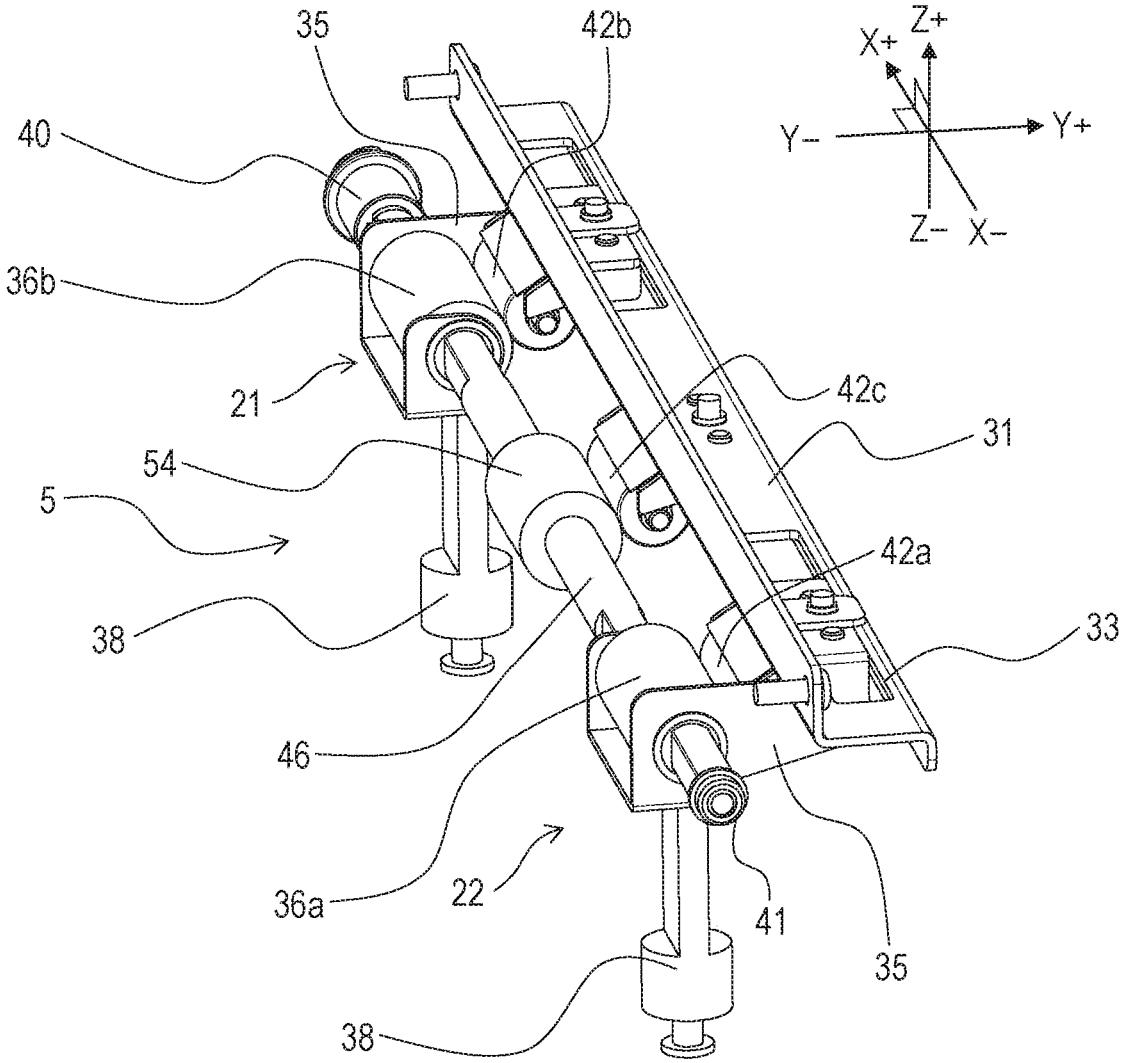
FIG. 5 is a perspective view of the image forming apparatus according the first embodiment of the present disclosure illustrating the configuration thereof.

FIG. 5 is a perspective view of the conveying unit 5 illustrating the configuration thereof. The conveying unit 5 includes a plurality of driving rotary members mounted to a conveying roller shaft 46, that is, at least a central roller 54 and end rollers 36*a* and 36*b* at both sides of the central roller 54. The conveying roller shaft 46 is rotatably supported by a bearing 41 and a coupling 40 (a driving transmission member). The coupling 40 rotates when a driving force is transmitted from a driving source (not illustrated) on the main body side, so that the coupling 40 and the conveying roller shaft 46 rotate together. The rotation of the conveying roller shaft 46 causes the central roller 54 and the end rollers 36*a* and 36*b* to rotate, thereby conveying the sheet S fed by the feeding roller 3.

A plurality of rollers 42 (driven rotary members) are disposed at positions facing the central roller 54 and the end rollers 36*a* and 36*b*. The rollers 42 are driven to rotate by the rotation of the facing driving rotary members. The conveying unit 5 conveys the sheet S at conveying portions, which are conveying nip areas that the central roller 54 and the end rollers 36*a* and 36*b* form with the rollers 42.

The rollers 42 are respectively pressed toward the facing central roller 54 and the end rollers 36*a* and 36*b* to form the conveying portions. Although the material of the surfaces of the rollers 42 in contact with the sheet S is a tetrafluoroethylene-perfluoroalkylvinylether copolymer (PFA), the material is not limited thereto. The material of the surfaces of the rollers 42 need only be a material that is charged so as to sufficiently attract paper dust to static electricity. The paper dust here contains any substances derived from the constituents of the sheet S, which are generated from the sheet S and adhering to the sheet S, for example, during processing of the sheet S, such as cutting or when the sheet S is rubbed by another member. The paper dust typically contains cellulose-based fibers and a filler, such as calcium carbonate powder.

A roller 42*c* facing the central roller 54 is fixed in the lateral direction (the X-direction) which is the axial direction of the rollers 42 and is rotatably mounted to a roller stay 31 (a fixing unit). A roller 42*a* facing the end roller 36*a* is movable in the lateral direction (the X-direction) and is movably mounted to the roller stay 31. In other words, the roller 42*a*, which is one of the plurality of driven rotary members 42, is a first driven rotary member.

Likewise, a roller 42*b* facing the end roller 36*b* is movable in the lateral direction (the X-direction) and is movably mounted to the roller stay 31. In other words, the roller 42*b*, which is one of the plurality of driven rotary members 42, is a second driven rotary member.

The end roller 36*a* is held by a cleaning unit 22 (a first holding unit). The end roller 36*b* is held by a cleaning unit 21 (a second holding unit). The cleaning unit 22 and the cleaning unit 21 are movable in the lateral direction with respect to the roller stay 31.

Figure 6:
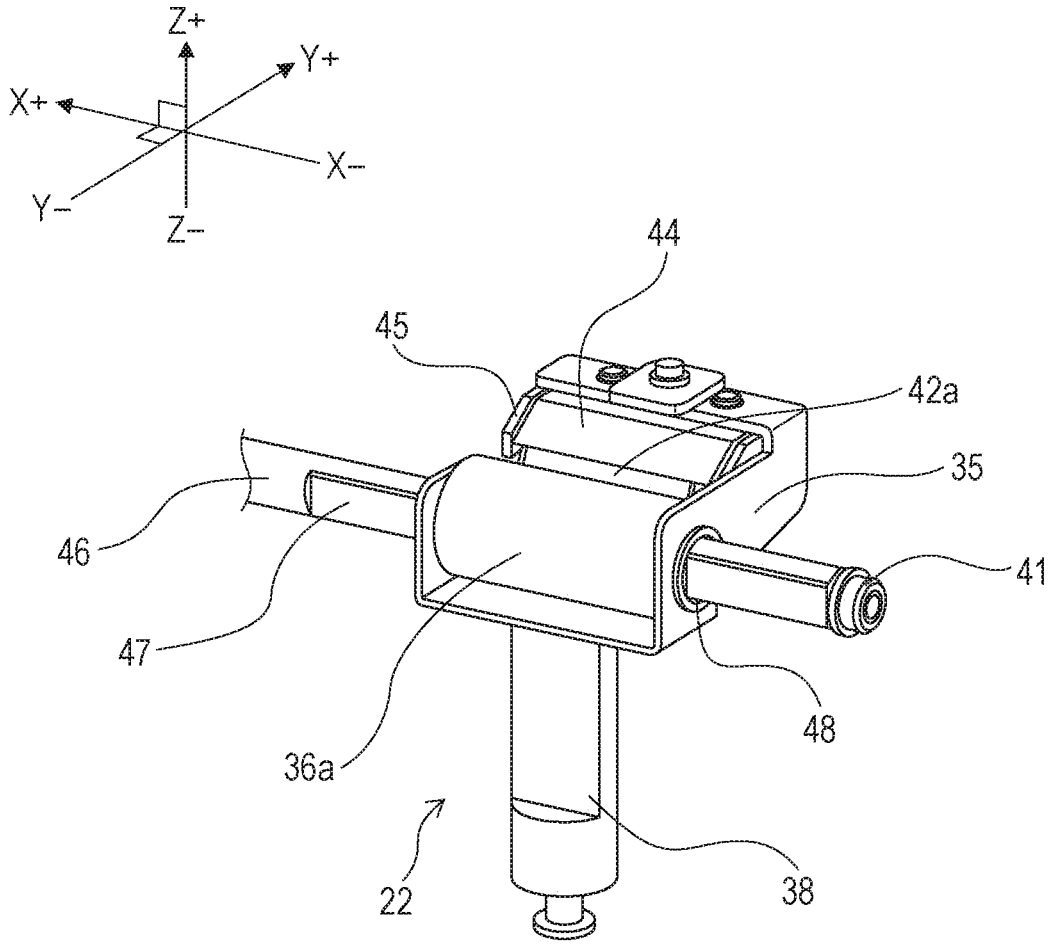
FIG. 6 is a perspective view of the image forming apparatus according the first embodiment of the present disclosure illustrating the configuration thereof.

FIG. 6 illustrates the cleaning unit 22 in detail. The cleaning unit 21 has the same configuration as the cleaning unit 22, and a description thereof will be omitted. Assuming that the components of the cleaning unit 22 are referred to as first components, the components of the cleaning unit 21 are referred to as second components.

A roller sleeve 48 is provided as the core of the end roller 36*a* made of rubber. The conveying roller shaft 46 has a cut surface 47 to regulate the rotational direction of the roller sleeve 48 but is movable in the axial direction. Thus, when the conveying roller shaft 46 is rotated, the rotational force can be transmitted to the roller sleeve 48, and the roller sleeve 48 can move in the axial direction. The roller sleeve 48 is fixed by fixing members 35. The roller sleeve 48 is moved in the axial direction of the conveying roller shaft 46 by moving fixing blocks 38 (working members) mounted to the fixing members 35. (The fixing block 38 of the first holding unit is referred to as a first working member, and the fixing block 38 of the second holding unit is referred to as a second working member.) The fixing member 35 also holds the roller 42*a* to constitute the cleaning unit 22.

Figure 7:
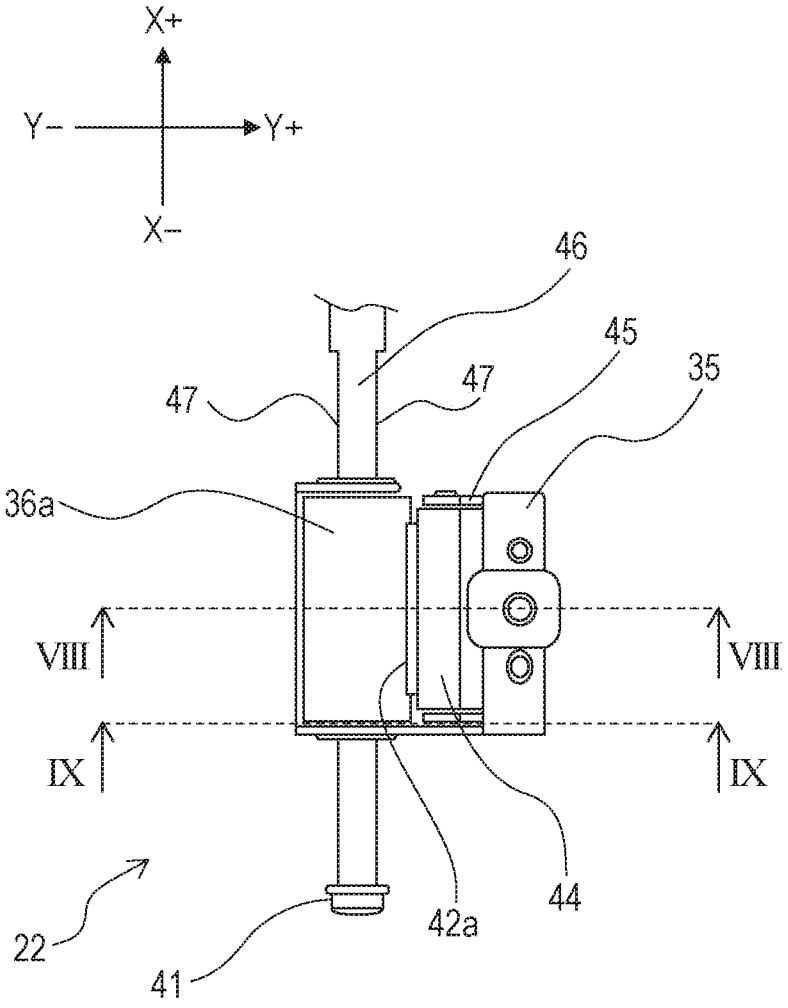
FIG. 7 is a top of the image forming apparatus according the first embodiment of the present disclosure illustrating the configuration thereof.
Figure 8:
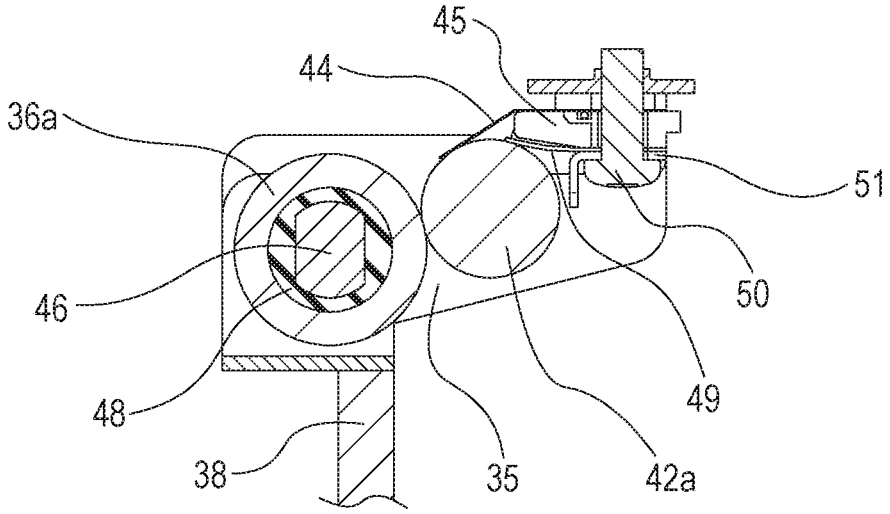
FIG. 8 is a cross-sectional view of the image forming apparatus according the first embodiment of the present disclosure illustrating the configuration thereof.
Figure 9:
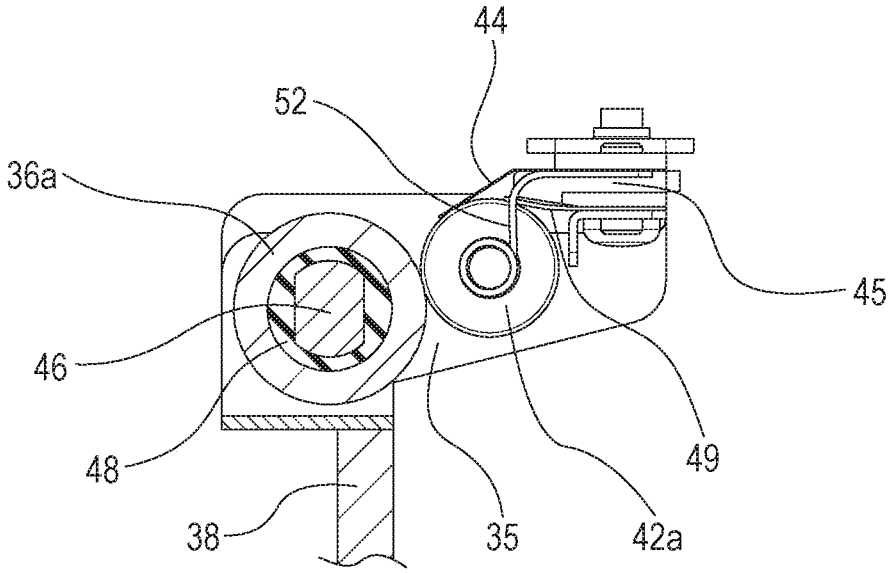
FIG. 9 is a cross-sectional view of the image forming apparatus according the first embodiment of the present disclosure illustrating the configuration thereof.

FIG. 7 is a top view of the cleaning unit 22. FIG. 8 is a cross-sectional view taken along line VIII-VIII in FIG. 7. FIG. 9 is a cross-sectional view taken along line IX-IX in FIG. 7.

The cleaning unit 22 can scrape paper dust adhering to the surface of the roller 42*a* by pressing an end face of a sheet-like scraper 49 (a first collecting member) against the surface of the roller 42*a*. The scraper 49 can also scrape adhering substances other than paper dust, such as scattered toner and floating dust. The scraped paper dust is collected between an anti-scattering sheet 44 (a sealing member) and the scraper 49 so as not to scatter around. The scraper 49 is fixed between a scraper fixing unit 51 and a roller guide 45 (a collecting-member fixing member). The anti-scattering sheet 44 is fixed between the roller guide 45 and the fixing member 35. The scraper fixing unit 51 that holds the scraper 49 is fixed with a screw 50, with the scraper 49, the roller guide 45, and the anti-scattering sheet 44 held between the scraper fixing unit 51 and the fixing member 35. Both ends of the roller 42*a* are rotatably supported by wire springs 52 and are pressed toward the end roller 36*a*.

Next, the operation of the cleaning units 21 and 22 of the image forming apparatus 1 of the present embodiment will be described with reference to FIGS. 10 to 16.

Figure 10:
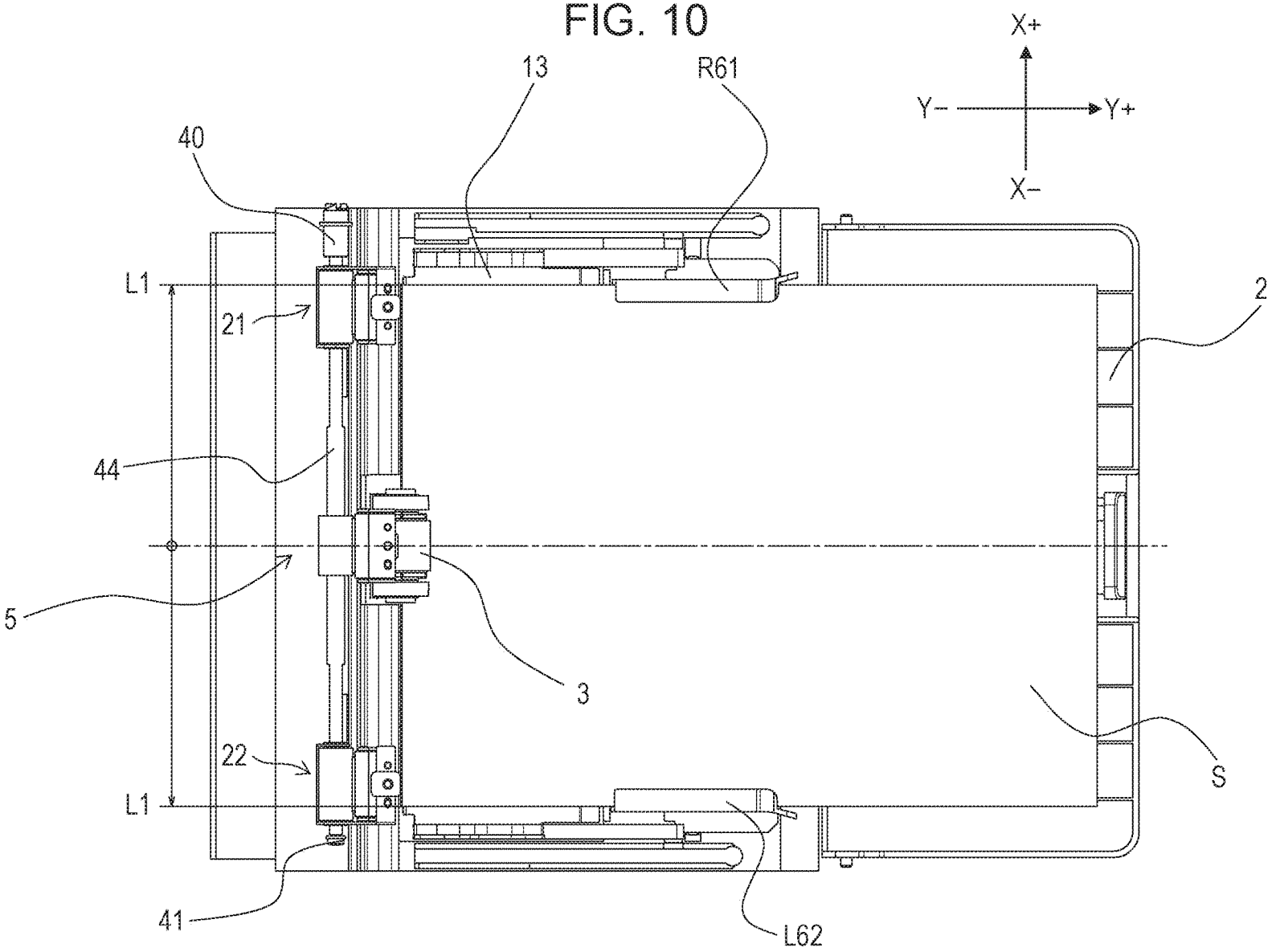
FIG. 10 is a top of the image forming apparatus according the first embodiment of the present disclosure illustrating the operation thereof.
Figure 11:
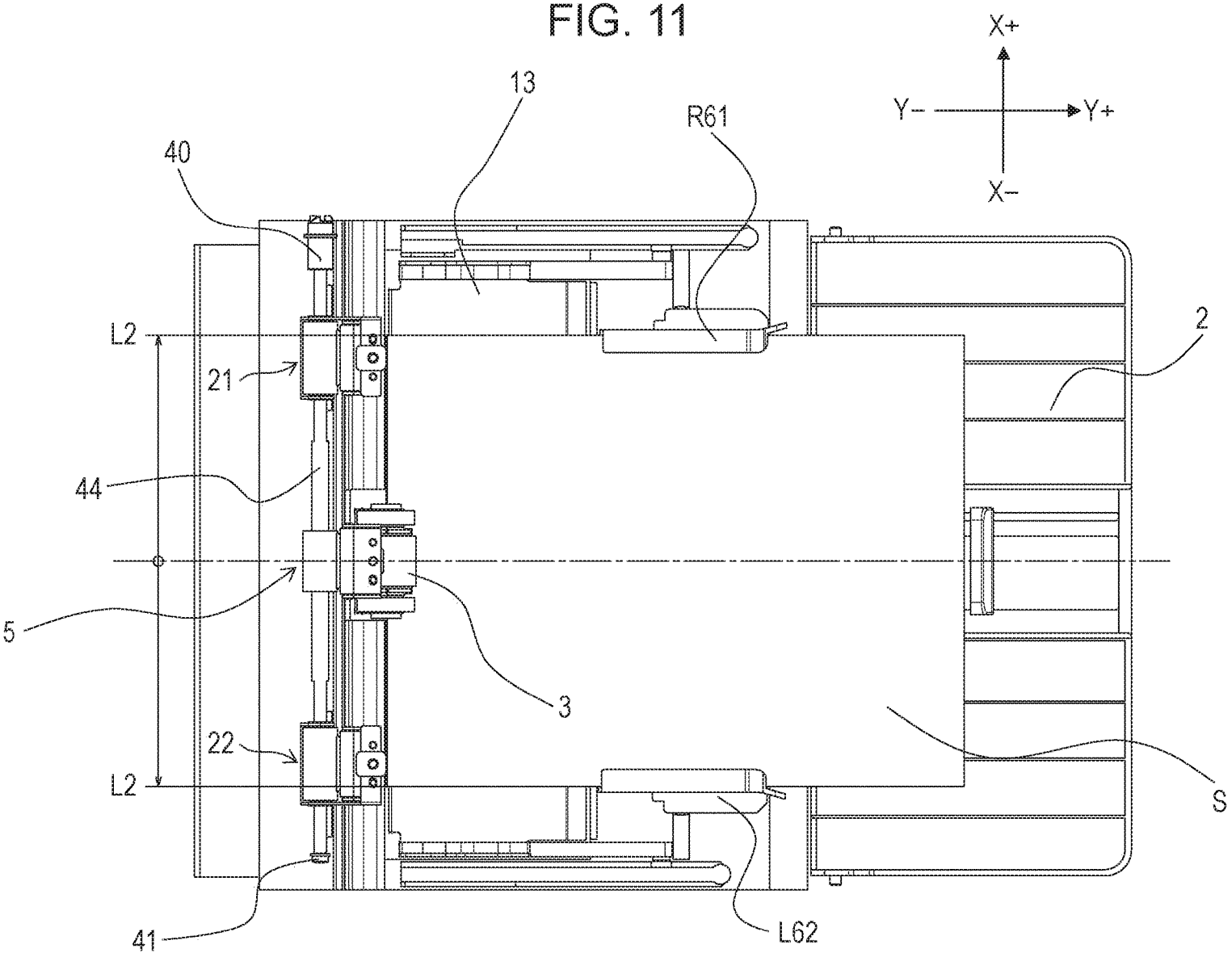
FIG. 11 is a top of the image forming apparatus according the first embodiment of the present disclosure illustrating the operation thereof.
Figure 12:
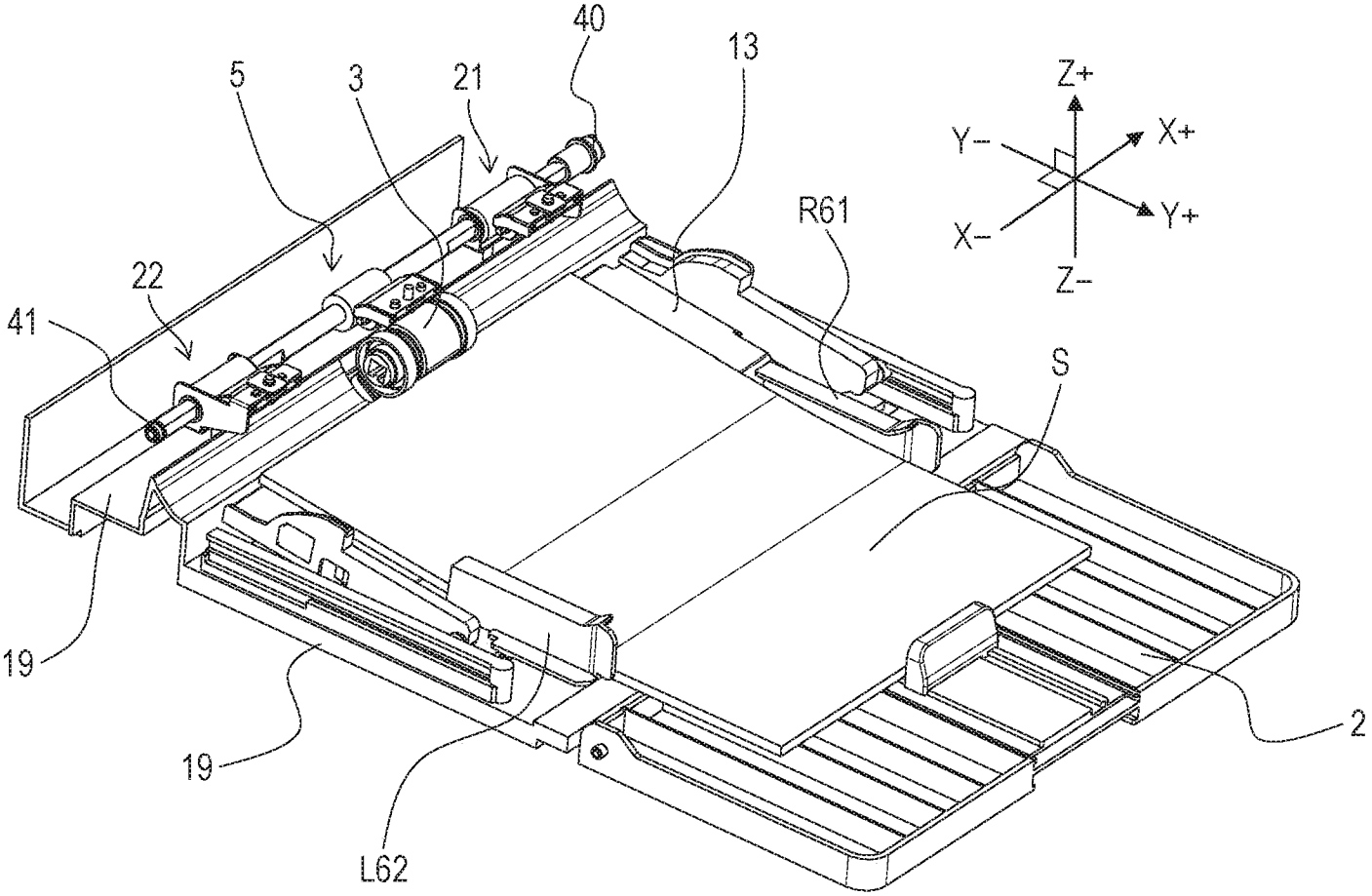
FIG. 12 is a perspective view of the image forming apparatus according the first embodiment of the present disclosure illustrating the configuration thereof.
Figure 13:
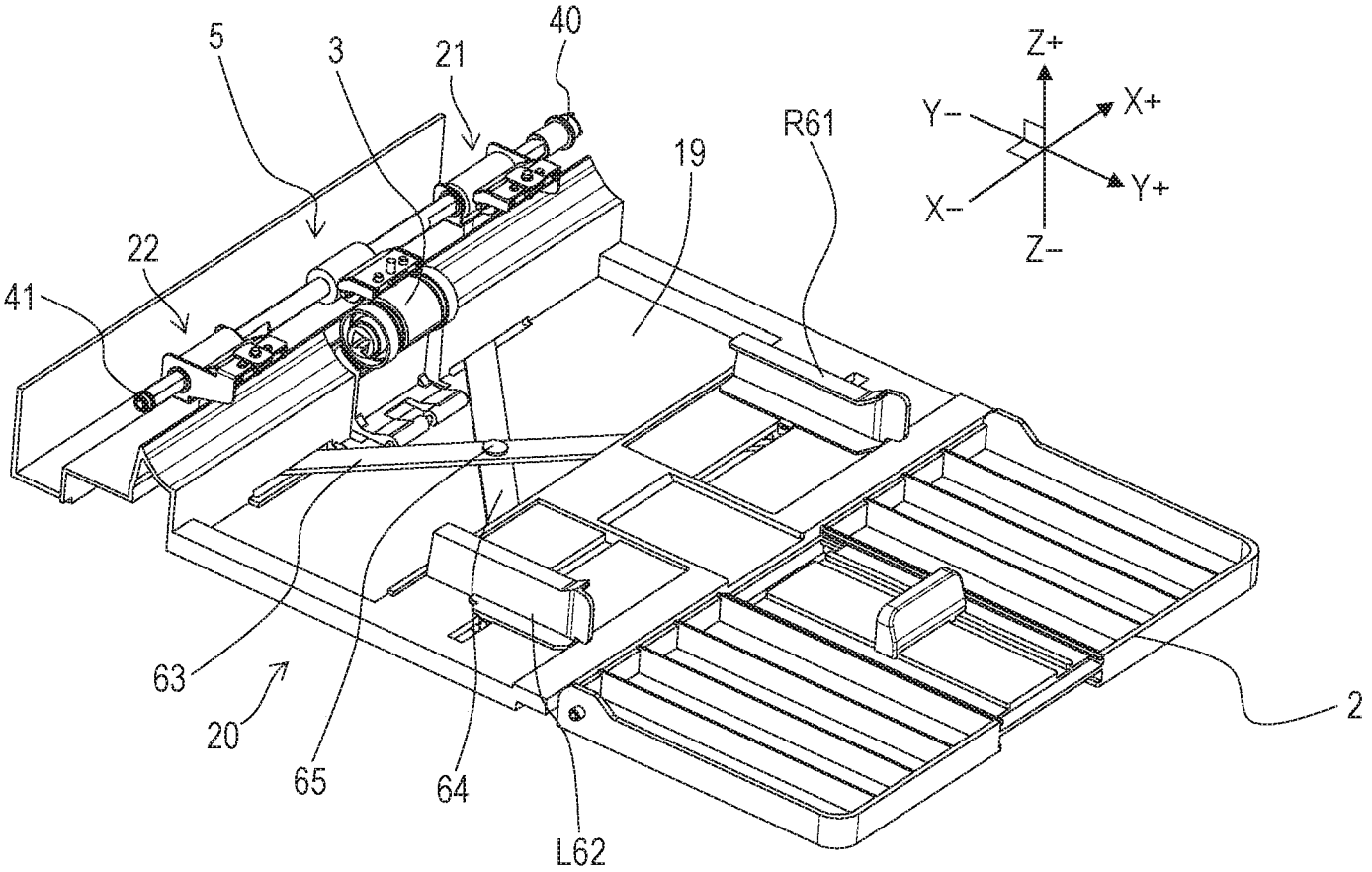
FIG. 13 is a perspective view of the image forming apparatus according the first embodiment of the present disclosure illustrating the configuration thereof.
Figure 14:
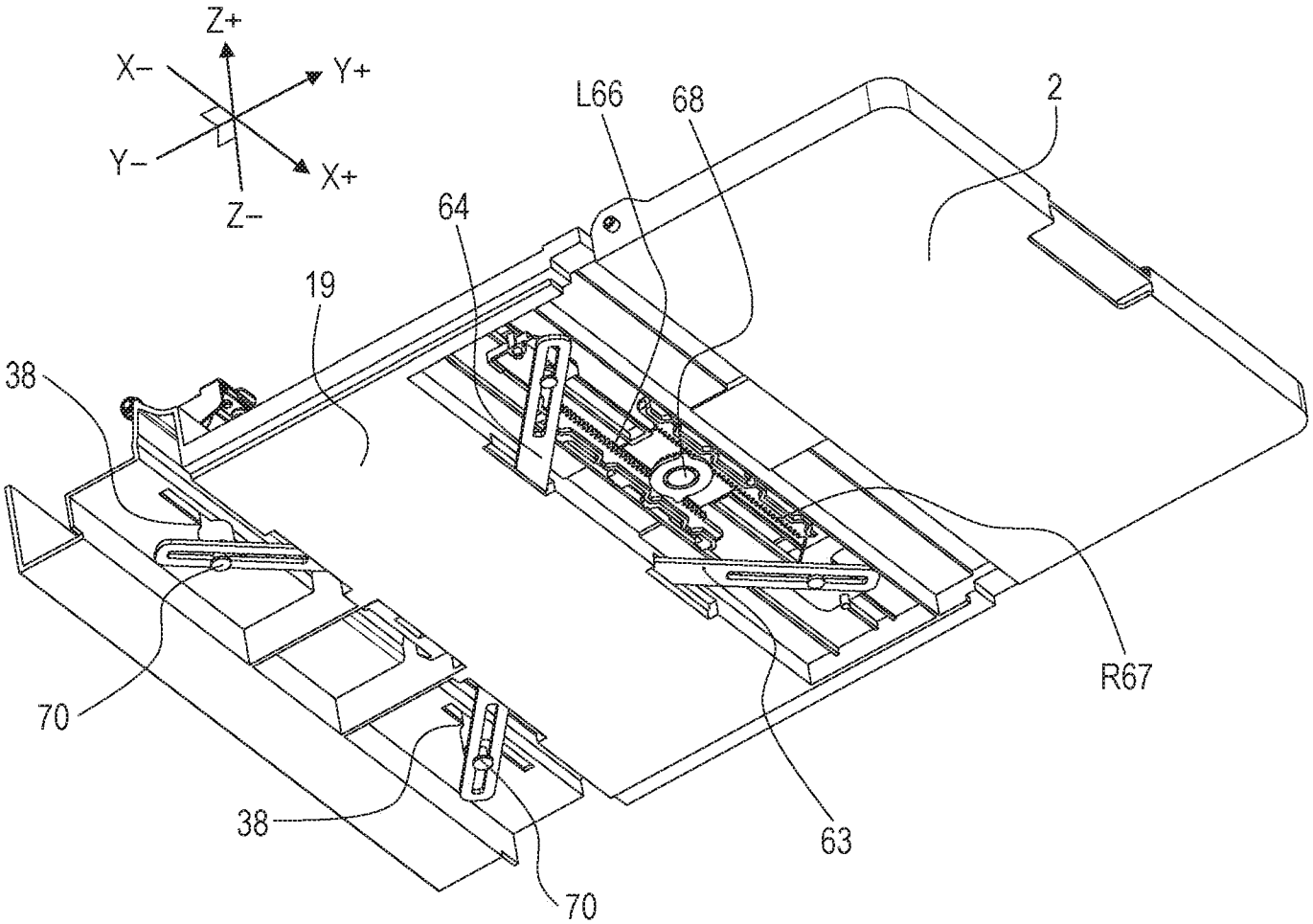
FIG. 14 is a perspective view of the image forming apparatus according the first embodiment of the present disclosure illustrating the configuration thereof.
Figure 15:
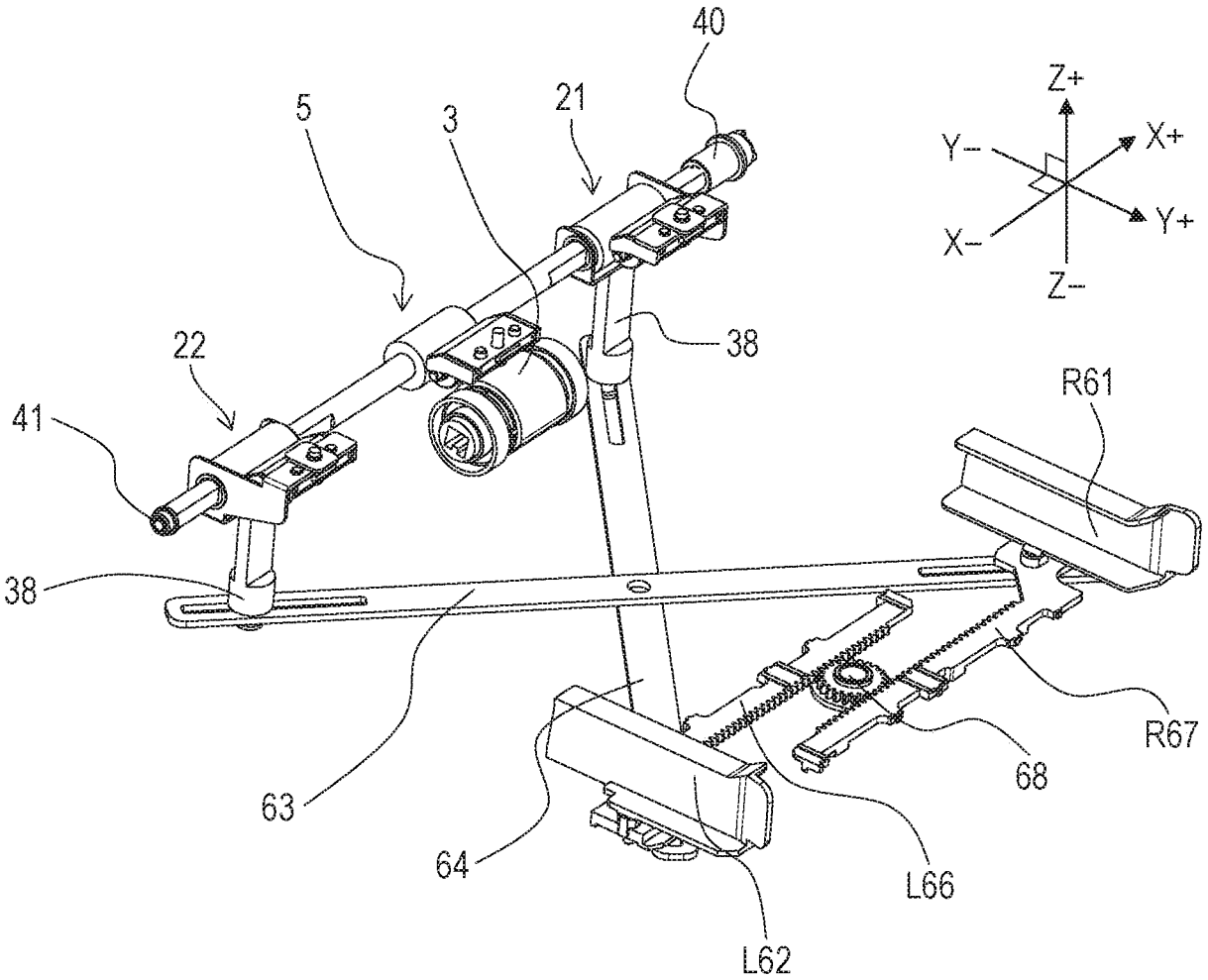
FIG. 15 is a perspective view of the image forming apparatus according the first embodiment of the present disclosure illustrating the configuration thereof.
Figure 16:
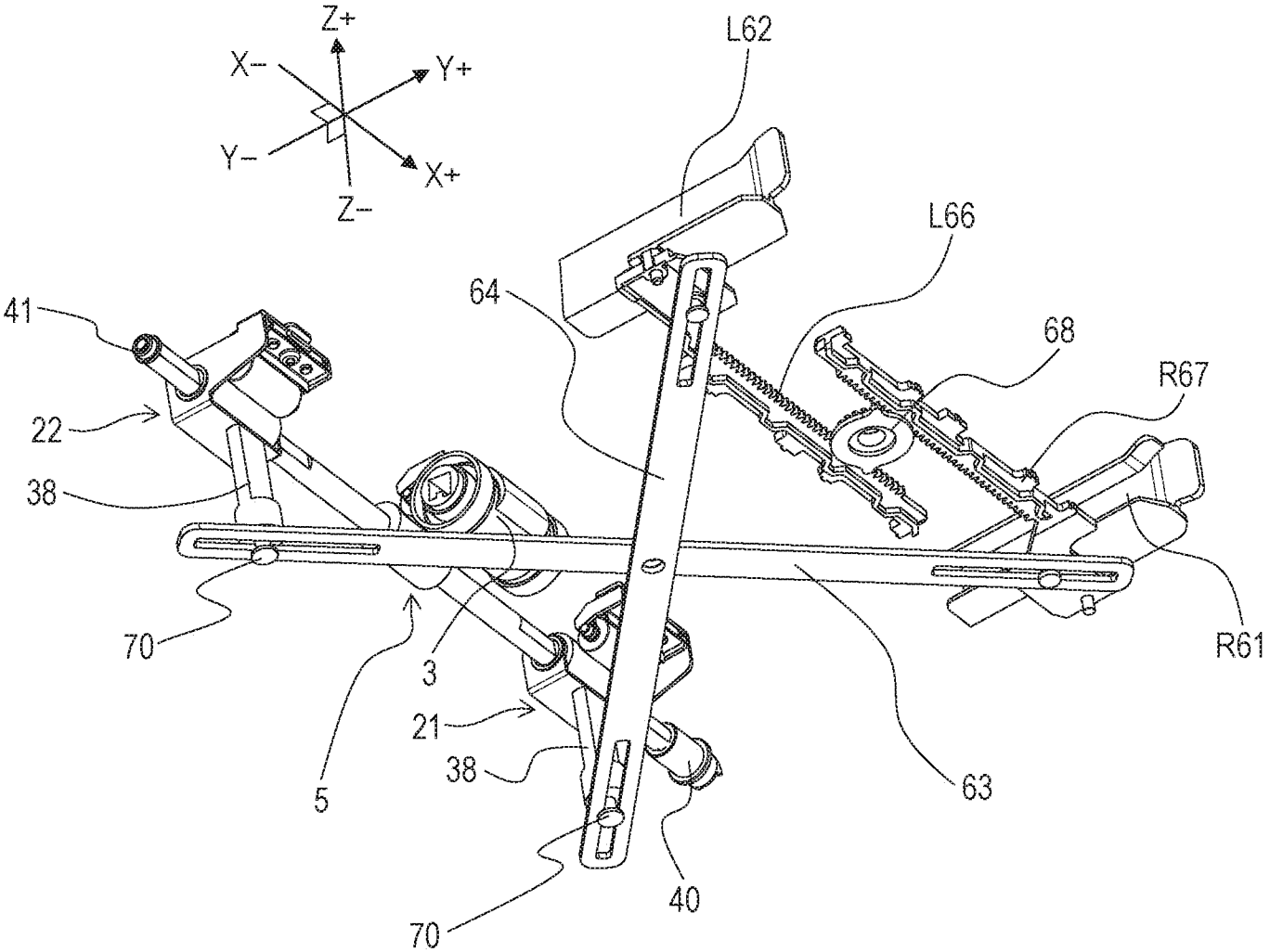
FIG. 16 is a perspective view of the image forming apparatus according the first embodiment of the present disclosure illustrating the configuration thereof.

FIG. 10 illustrates a case in which A4-size (first standard size) paper is set as the sheets S in top view. FIG. 11 illustrates a case in which B5-size (second standard size) paper is set in top view. The A4 size is 210 mm in width, and the B5 size is 182 mm in width. FIG. 12 is a perspective view of the state in FIG. 11. FIGS. 13 and 14 illustrate a state in which the sheet S and the lift plate 13 are removed from FIG. 12 to illustrate the configuration of an linking unit 20 in perspective view. FIG. 13 is a diagram viewed from diagonally above. FIG. 14 is a diagram viewed from diagonally back. FIGS. 15 and 16 are diagrams in which a sheet feed frame 19 and the sheet feed tray 2 in FIGS. 13 and 14 are removed, illustrating the connection among the sheet-width regulating plates, the X-link, and the paper-dust removing roller unit.

The present embodiment includes a first regulating member and a second regulating member as regulation units, which move in conjunction with each other. A sheet-width regulating plate R61 (the first regulating member) and a sheet-width regulating plate L62 (the second regulating member) are used to regulate one end and the other end in the widthwise direction perpendicular to the sheet S conveying direction and are mounted to the sheet feed frame 19. When the sheet size is changed, and the sheets S are reset in the sheet feed tray 2, as in FIGS. 10 and 11, the sheet-width regulating plates R61 and L62 are moved to the width of the sheets S, thereby guiding the sheets S.

As in FIG. 14, the sheet-width regulating plate R61 includes a width regulating rack R67 (a first moving member), and the sheet-width regulating plate L62 includes a width regulating rack L66 (a second moving member). The width regulating rack R67 and the width regulating rack L66 are operatively connected by a pinion gear 68 disposed at the center. When one of the sheet-width regulating plate R61 and the sheet-width regulating plate L62 is moved by the operative connection, the other is also moved in conjunction therewith, so that the sheets S can be always regulated at the center of the main body. The sheets S in FIG. 10 are A4 size at 210 mm in width and 105 mm in length L1. The sheets S in FIG. 11 are B5 size, at 182 mm in width and 91 mm in length L2. When the sheet-width regulating plate R61 or the sheet-width regulating plate L62 is moved, the cleaning units 21 or 22 is also moved by the linking unit 20. At that time, the roller 42*a* and the end roller 36*a* can be kept contacted, so that a separating mechanism is not needed.

As illustrated in FIGS. 10 and 11, the respective rollers 42*a* and 42*b* of the cleaning units 21 and 22 respectively move in conjunction with the movement of the sheet-width regulating plate R61 and the sheet-width regulating plate L61 to positions corresponding to the ends of the sheets S placed on the sheet feed tray 2. Thus, the cleaning units 21 and 22 can collect the paper dust from the sheets S at the position corresponding to the lateral ends of the sheets S.

Referring to FIGS. 13 to 16, the linking unit 20 that operatively connects the movement of the sheet-width regulating plate R61 and the sheet-width regulating plate L62 and the movement of the cleaning units 21 and 22 will be described. The linking unit 20 includes X-links 63 and 64 (first and second connecting members) and an X-link fulcrum 65 which is the fulcrum of the rotation of the X-links 63 and 64.

As illustrated in FIG. 13, the X-links 63 and 64 are fixed to the sheet feed frame 19 so as to be rotatable about the X-link fulcrum 65. As illustrated in FIG. 14, ends of the X-links 63 and 64 are respectively slidably supported by the width regulating rack R67 and the width regulating rack L66, and the other ends of the X-links 63 and 64 are fixed to the fixing blocks 38 with X-link fixing shafts 70.

FIGS. 15 and 16 are diagrams illustrating only operable link parts. The motion of the sheet-width regulating plate R61 and the sheet-width regulating plate L62 is transmitted to the fixing blocks 38 via the X-links 63 and 64. Since the X-link fulcrum 65 is positioned at the center between the position where the sheet-width regulating plate R61 (L62) is supported and the position where the X-link fixing shaft 70 of the fixing block 38 is supported, the amount of movement of the sheet-width regulating plate R61 (L62) is equal to the amount of movement of the fixing block 38. This link configuration allows the cleaning units 21 and 22 to move to the ends of the sheets S in conjunction with the movement of the sheet-width regulating plate R61 and the sheet-width regulating plate L62.

Thus, the cleaning units 21 and 22 can be moved according to the sheets S placed on the sheet feed tray 2 in correspondence with the positions of the ends of the sheets S, so that paper dust can be collected at the positions corresponding to the lateral ends of the sheets S.

The linking unit 20 has been described which has a configuration in which the movement of the cleaning unit 22 (the first holding unit) is operatively connected to the movement of the sheet-width regulating plate R61 (the first regulating member), and the movement of the cleaning unit 21 (the second holding unit) is operatively connected to the movement of the sheet-width regulating plate L62 (the second regulating member). However, the configuration of the present disclosure is not limited to the above configuration. For example, the sheet-width regulating plate L62 (the second regulating member) may be fixed as a reference member, and only the sheet-width regulating plate R61 (the first regulating member) may be moved with respect to the fixed sheet-width regulating plate L62. In this case, the second cleaning unit 21 corresponding to the sheet-width regulating plate L62 (the second regulating member) is fixed to the sheet feed frame 19. In this configuration, the linking unit 20 may operatively connect only the movement of the sheet-width regulating plate R61 and the movement of the first cleaning unit 22.

In the present embodiment, the holding units and the regulation units of the image forming apparatus 1 are operatively connected to each other. However, if a holding unit and a regulation unit of a sheet conveying unit 100 for conveying the sheets S to an image forming unit of the image forming apparatus 1 are operatively connected to each other, the same advantageous effects can be provided.

Figure 17:
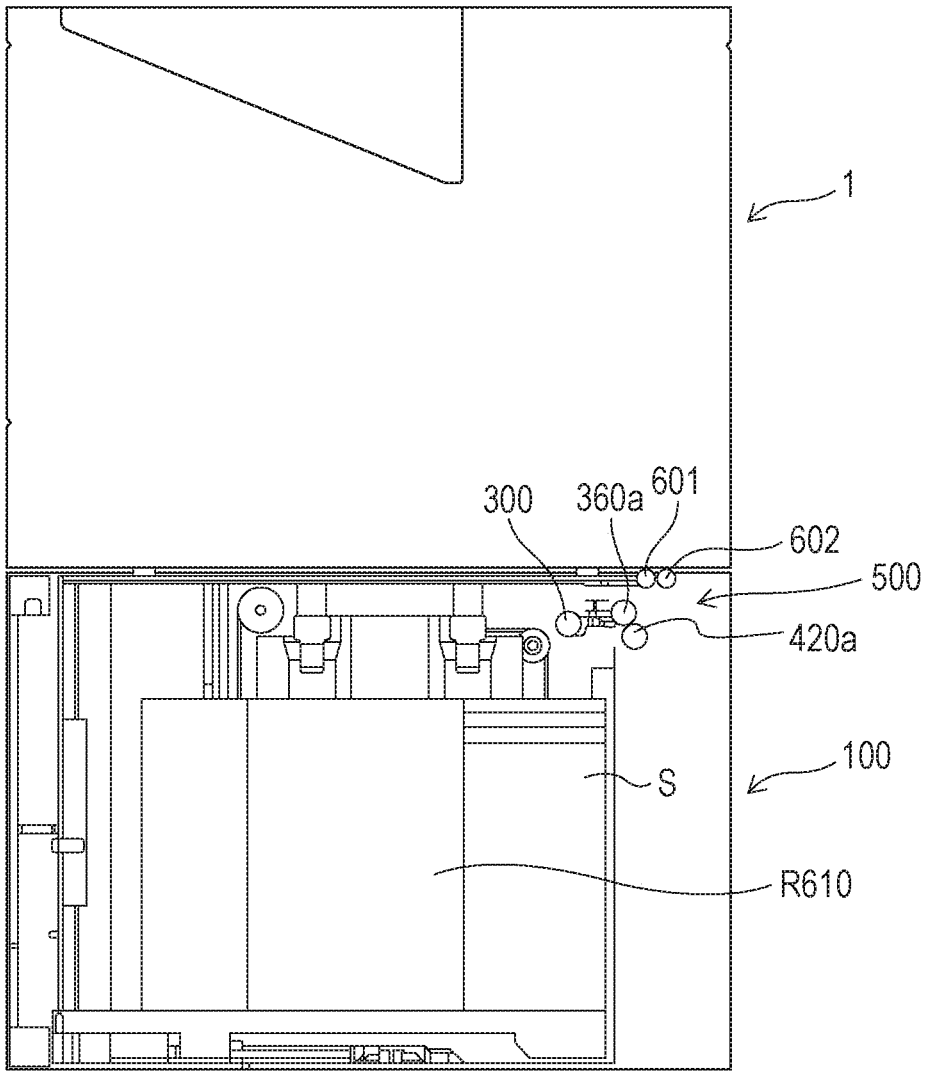
FIG. 17 is a cross-sectional view of the image forming apparatus according the first embodiment of the present disclosure illustrating the configuration thereof.

FIG. 17 is a cross-sectional view of the sheet conveying unit 100 to which the present disclosure is applicable. The sheet conveying unit 100 in FIG. 17 is detachably mounted to the image forming apparatus 1. The sheet conveying unit 100 includes a regulation unit, a cleaning unit, and an linking unit, like the image forming apparatus 1. FIG. 17 illustrates a sheet-width regulating plate R610 which is part of the regulation unit and a roller 420*a* which is part of the cleaning unit. An end roller 360*a*, which is one of a plurality of driving rotary members, is opposed to the roller 420*a* to constitute a conveying unit 500. A second conveying unit 600 (601, 602) is disposed downstream from the conveying unit 500. A feeding roller 300 and the conveying unit 500 convey the sheets S to the image forming unit in the image forming apparatus 1.

This sheet conveying unit 100 can also always collect paper dust at positions corresponding to the lateral ends of the sheets S by operatively connecting the regulation unit and the cleaning unit using the linking unit.

While the present disclosure has included a description with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-209485 filed Oct. 30, 2017, which is hereby incorporated by reference herein in its entirety.

What is claimed is:

1. An image forming apparatus comprising:

an image bearing member configured to carry a toner image;

a transfer member forming a transfer portion with the image bearing member and configured to transfer the toner image at the transfer portion;

a stack member on which sheets are to be stacked;

a plurality of driving rotary members configured to convey the sheets stacked on the stack member toward the transfer portion by rotating when driving is transmitted, the driving rotary members comprising at least a first driving rotary member;

a regulation unit configured to regulate an end of the sheets stacked on the stack member;

a plurality of driven rotary members respectively opposed to the plurality of driving rotary members, the driven rotary members being driven by rotation of the opposing driving rotary members, the driven rotary members comprising at least a first driven rotary member;

a first collecting member in contact with the first driven rotary member to collect a substance adhering to the first driven rotary member;

a first holding unit configured to hold the first driven rotary member and the first collecting member; and a linking unit configured to move the first holding unit in an axial direction of the first driven rotary member in conjunction with movement of the regulation unit.

2. The image forming apparatus according to claim 1, wherein the first holding unit holds the first driving rotary member facing the first driven rotary member, and wherein, when the first holding unit is moved by the linking unit, the first holding unit moves while keeping the first driven rotary member and the first driving rotary member in contact.

3. The image forming apparatus according to claim 1, wherein the driving rotary members comprise a second driving rotary member, wherein the driven rotary members comprise a second driven rotary member, and wherein the image forming apparatus further comprises:

a second collecting member configured to collect a substance adhering to the second driven rotary member; and a second holding unit configured to hold the second driven rotary member and the second collecting member, wherein the second holding unit is moved in the axial direction by the linking unit in conjunction with movement of the regulation unit.

4. The image forming apparatus according to claim 3, wherein the regulation unit comprises:

a first regulating member configured to regulate one end of the sheets in a lateral direction perpendicular to a direction in which the sheets are conveyed by the plurality of driving rotary members; and a second regulating member configured to regulate another end of the sheets in the lateral direction.

5. The image forming apparatus according to claim 4, wherein the linking unit operatively connects movement of the first holding unit to movement of the first regulating member.

6. The image forming apparatus according to claim 5, further comprising:

a first moving member configured to move the first regulating member in the lateral direction, wherein the first holding unit comprises a first working portion, and wherein the linking unit comprises a first connecting member that is supported so as to be movable with respect to the first moving member at one end and that is fixed to the first working portion of the first holding unit at another end.

7. The image forming apparatus according to claim 5, wherein the linking unit operatively connects movement of the second holding unit and movement of the second regulating member.

8. The image forming apparatus according to claim 7, further comprising:

a second moving member configured to move the second regulating member in the lateral direction, wherein the second holding unit comprises a second working portion, and wherein the linking unit comprises a second connecting member that is supported so as to be movable with respect to the second moving member at one end and that is fixed to the second working portion of the second holding unit at another end.

9. The image forming apparatus according to claim 3, wherein the driven rotary members further comprise a third driven rotary member between the first driven rotary member and the second driven rotary member in the axial direction, the axial position of the third driven rotary member being fixed.

10. The image forming apparatus according to claim 9, wherein, when the second holding unit is moved by the linking unit, the second holding unit moves while keeping the second driven rotary member and the second driving rotary member in contact.

11. A conveying unit that conveys a sheet toward an image forming unit, the conveying unit comprising:

a stack member on which sheets are to be stacked;

a plurality of driving rotary members configured to convey the sheets stacked on the stack member toward the image forming unit by rotating when driving is transmitted, the driving rotary members comprising at least a first driving rotary member;

a regulation unit configured to regulate an end of the sheets stacked on the stack member;

a plurality of driven rotary members respectively opposed to the plurality of driving rotary members, the driven rotary members being driven by rotation of the opposing driving rotary members, the driven rotary members comprising at least a first driven rotary member;

a first collecting member in contact with the first driven rotary member to collect a substance adhering to the first driven rotary member;

a first holding unit configured to hold the first driven rotary member and the first collecting member; and an linking unit configured to move the first holding unit in an axial direction of the first driven rotary member in conjunction with movement of the regulation unit.

12. The conveying unit according to claim 11, wherein the first holding unit holds the first driving rotary member facing the first driven rotary member, and wherein, when the first holding unit is moved by the linking unit, the first holding unit moves while keeping the first driven rotary member and the first driving rotary member in contact.

13. The conveying unit according to claim 12, wherein the driving rotary members comprise a second driving rotary member, wherein the driven rotary members comprise a second driven rotary members, and wherein the conveying unit further comprises:

a second collecting member configured to collect a substance adhering to the second driven rotary member; and a second holding unit configured to hold the second driven rotary member and the second collecting member, wherein the second holding unit is moved in the axial direction by the linking unit in conjunction with movement of the regulation unit.

14. The conveying unit according to claim 13, wherein the regulation unit comprises:

a first regulating member configured to regulate one end of the sheets in a lateral direction perpendicular to a direction in which the sheets are conveyed by the plurality of driving rotary members; and a second regulating member configured to regulate another end of the sheets in the lateral direction.

15. The conveying unit according to claim 14, wherein the linking unit operatively connects movement of the first holding unit to movement of the first regulating member and operatively connects movement of the second holding unit to movement of the second regulating member.

* * * * *